US006976279B1

(12) United States Patent
Berke et al.

(10) Patent No.: US 6,976,279 B1
(45) Date of Patent: Dec. 20, 2005

(54) EYE INJURY TREATMENT STATION

(75) Inventors: Joseph J. Berke, West Bloomfield, MI (US); Charles T. Michael, Troy, MI (US); Alex Rhodes, West Bloomfield, MI (US)

(73) Assignee: Berke-Tec, Inc., Detroit, MI (US)

( * ) Notice: Subject to any disclaimer, the term of this patent is extended or adjusted under 35 U.S.C. 154(b) by 0 days.

(21) Appl. No.: 10/637,077

(22) Filed: Aug. 8, 2003

(51) Int. Cl.[7] ..... A61H 33/00; A61H 33/04

(52) U.S. Cl. ..... 4/620; 4/616; 239/146; 239/373; 239/375

(58) Field of Search ..... 4/602, 603, 615–617, 4/619, 621, 625, 630; 239/16, 128, 146, 333, 239/335, 355, 360, 373, 375; 604/294, 295

(56) References Cited

U.S. PATENT DOCUMENTS

| | | | | | |
|---|---|---|---|---|---|
| 419,442 | A | * | 1/1890 | Hildreth | 4/625 |
| 2,486,824 | A | * | 11/1949 | Daniels | 4/621 |
| 2,772,921 | A | * | 12/1956 | Nance | 239/373 |
| 3,656,481 | A | * | 4/1972 | Ness | 604/294 |
| 4,012,798 | A | | 3/1977 | Liautaud | |
| 4,493,119 | A | * | 1/1985 | Baumann | 4/620 |
| 4,627,845 | A | * | 12/1986 | DeMotte | 4/620 |
| 4,652,062 | A | * | 3/1987 | Greenwood | 312/209 |
| 4,817,403 | A | * | 4/1989 | Dimmick | 70/69 |
| 5,157,798 | A | * | 10/1992 | Van Kammen | 4/620 |
| 5,216,765 | A | * | 6/1993 | Paterson et al. | 4/620 |
| 5,381,567 | A | * | 1/1995 | Tanner et al. | 4/620 |
| 5,398,987 | A | * | 3/1995 | Sturgis | 296/37.6 |
| 5,465,438 | A | * | 11/1995 | Allman et al. | 4/630 |
| 5,508,283 | A | | 4/1996 | Eicken et al. | |
| 5,695,124 | A | | 12/1997 | Demeny et al. | |
| 5,810,213 | A | * | 9/1998 | Flores et al. | 239/373 |
| 5,850,641 | A | | 12/1998 | Demeny et al. | |
| 5,911,520 | A | * | 6/1999 | Kenney | 4/615 |
| 6,116,426 | A | * | 9/2000 | Slonim | 206/570 |
| 6,296,626 | B1 | | 10/2001 | Stein | |
| 6,336,917 | B1 | | 1/2002 | Berke | |
| 6,398,766 | B1 | | 6/2002 | Branch | |
| 6,444,692 | B1 | | 9/2002 | Schelberger et al. | |

FOREIGN PATENT DOCUMENTS

| | | | | | |
|---|---|---|---|---|---|
| DE | 3123153 | A1 | * | 12/1982 | B62H 3/00 |
| GB | 2123697 | A | * | 2/1984 | A61H 35/00 |

* cited by examiner

*Primary Examiner*—Tuan Nguyen
(74) *Attorney, Agent, or Firm*—Alex Rhodes

(57) ABSTRACT

A portable stand alone treatment station for eyes which have been exposed to corrosive liquids, noxious gases and foreign objects. An eye washing fluid reservoir and one or more applicators are mounted on a two-wheel cart. The eye washing fluid in the reservoir is stored under pressure to discharge the eye washing fluid from the applicator when a resiliently biased valve is opened. The tank is pressurized by a hand pump mounted in the tank or through a valve in a wall of the tank. The portability of the station allows it to be relocated on an as needed basis or to be transported to an injured person and carried in a vehicle.

17 Claims, 5 Drawing Sheets

EYE INJURY TREATMENT STATION

FIELD OF THE INVENTION

This invention relates to apparatus for treating injuries and more particularly to a treatment station for eye injuries.

BACKGROUND OF THE INVENTION

Eyes are exposed to corrosive liquids, noxious gases and foreign objects in vehicles, manufacturing plants, homes, sporting events, construction sites, laboratories, chemical plants, foundries and other facilities. Injured eyes require immediate attention to prevent permanent, irreversible consequences. A short delay can permanently impair a person's vision. They can substantially affect his earning ability, depress his lifestyle and increase an employer's cost of doing business because of absence and liability. Despite the ongoing exposure of eyes to injuries and the need for immediate treatment, few treatment facilities are immediately available when injuries occur. Moreover, available facilities offer only minimal benefits.

Section 1910.151 of the Occupational Safety and Health Act of 1970 (OSHA), Title 29, Code of Federal Regulations, requires "suitable facilities for quick drenching or flushing eyes and body within the work area for immediate use" when eyes are exposed to injurious corrosive materials. However, the regulations neither apply to private parties nor businesses with fewer than ten employees. Nor do they define "suitable facilities" or require at a work area materials, such as burn ointments, antibiotics, antidotes, bandages, sterile gauze pads or eye patches.

Voluntary standard ANSI Z358.1 which is more specific than the OSHA regulations includes a check list of desirable features for an eye wash station. One requirement is that it be located within ten seconds of walking distance from a hazard. Another requirement is that a water temperature be "tepid". Still yet another requirement is an ability of delivering large quantities of water. One deficiency of the ANSI standard is that there is no requirement for a safe disposal of waste water. When strong substances such as acids and alkalis are present, a safe deposit of waste water is mandatory.

At many hazardous locations neither eye washing stations nor medications nor eye bandaging materials are available for injured eyes. Persons must travel, in some cases long distances, to receive treatment for injured eyes. Where eye washing stations are provided, most are limited to treating persons in standing positions. Still yet another problem is that many eye wash stations are inoperative during failures of plumbing or electrical power systems.

SUMMARY OF THE INVENTION

The present invention overcomes all of the above limitations and problems which are associated with treating eye injuries. One benefit of the invention is that it is a portable, "stand alone" treatment station. Thus, the treatment station can be easily relocated at a workplace or transported to injured persons on an "as needed" basis. This can be advantageous at places such as public events, laboratories, hospital emergency rooms and disaster sites where patients are often immobile or restricted to hospital carts and beds. Another benefit is that it includes eye treatment and eye covering materials. Thus, eye washing and treatment are immediately available. Still yet another benefit is that it is not disabled by power failures. Still yet another benefit is that a large amount of eye washing fluid is available. Thus, fluid is available for more than one person, including extinguishing hair and clothing fires, and diluting corrosive liquids on body areas.

One feature of the invention is that the treatment station is a compact station which can be easily stored in army field units, emergency vehicles, fire trucks, ambulances, etc. Another feature is that the eye washing station is a pressure system rather than a gravity system. Still yet another benefit is that eyes can be treated when injured persons are in standing, sitting and prone positions.

The invention is comprised of a two-wheel portable cart; a reservoir; an eye washing fluid, a cabinet; eye treatment materials, at least one fluid applicator; a disposal basin; and flexible tubing for connecting the applicator to the storage tank. In a first aspect of the invention, only an applicator is provided for spraying an eye washing fluid. In a second aspect of the invention, a pair of applicators are provided.

In employing the teaching of the present invention, a plurality of alternate embodiments can be provided to achieve the desired results and capabilities. In this disclosure, two alternate embodiments are discussed. However, these embodiments are intended as examples and should not be considered as limiting.

Further objects, benefits and characterizing features of the invention will become apparent from the ensuing detailed description and drawings which illustrate and describe the invention. The best mode which is contemplated in practicing the invention together with the manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

DETAILED DESCRIPTION OF A PREFERRED EMBODIMENT

Figure 2:
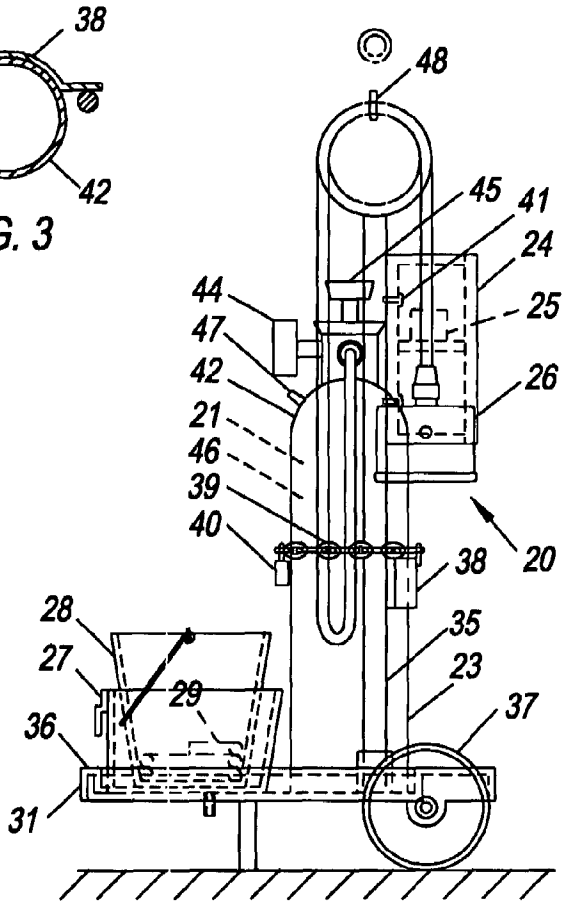
FIG. 2 is a left end view of the eye injury first aid station.

Referring now to the drawings wherein like numerals designate like and corresponding parts throughout the several views, the numeral 20 designates an eye treatment station which embodies the present invention. One distinguishing feature of the invention is that it is a compact station 20. Another distinguishing feature is that it is a "stand alone" station 20. Another distinguishing feature is that it is a portable station 20. Another feature is that substances 25 are provided, such as burn and antibiotic liquids and ointments, adhesive tape, sterile gauze, magnets and eye patches. Another distinguishing feature is that an eye washing fluid 21 is stored under pressure in a reservoir 23. These features individually and collectively provide versatility and a superior level of treatment heretofore unavailable.

Figure 3:
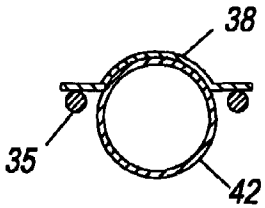
FIG. 3 is a cross-sectional view taken on the line 3—3 in FIG. 1.
Figure 1:
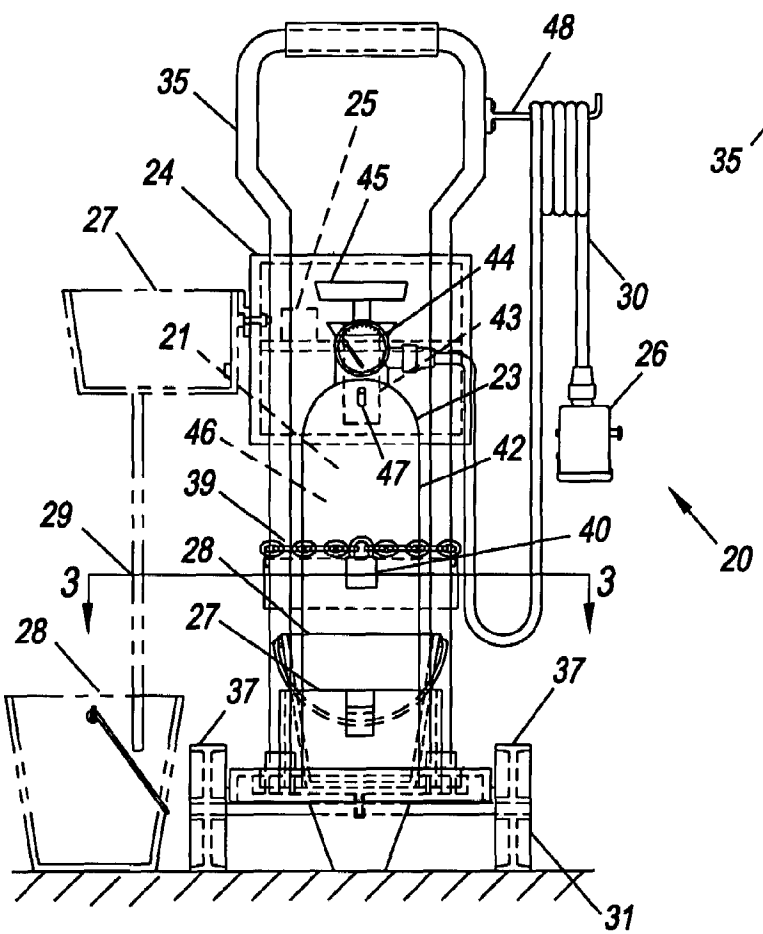
FIG. 1 is a front view of an eye injury first aid station with a face applicator according to the present invention.
Figure 5:
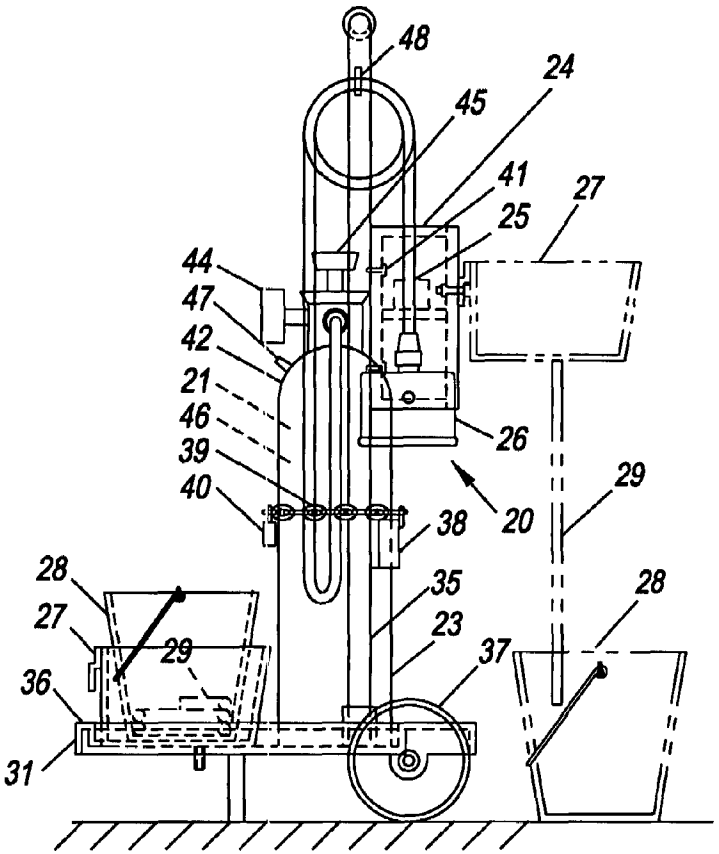
FIG. 5 is a left side view of the second embodiment.
Figure 4:
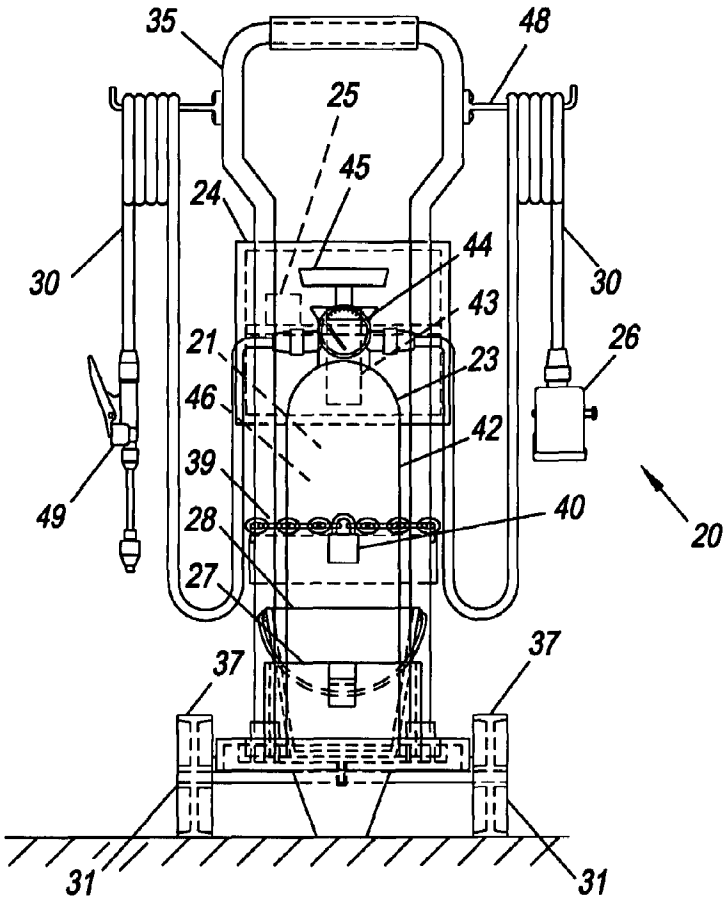
FIG. 4 is a front view of a second embodiment of the invention.

The treatment station 20, shown in FIGS. 1 through 3, inclusive, generally comprises a two-wheel cart 22; the reservoir 23 for storing the eye washing fluid 21; the eye washing fluid 21 stored in the reservoir 23, a cabinet 24 for storing the eye treatment substances 25, the eye treatment substances 25 stored in the cabinet 24, a fluid applicator 26 connected to the reservoir 23; a basin 27 for collecting spent fluid 21; a pail 28, a flexible tube 29 for transferring spent fluid 21 from the basin 27 to the pail 28 and a flexible tube 30 for connecting the applicator 26 to the reservoir 23.

With reference to FIGS. 1 and 2, one noteworthy feature of the invention is that the reservoir 23, cabinet 24, pail 28, basin 27, flexible tubes 29, 30 and applicator 26 are mounted on the cart 22. Thus, the station 20 can be quickly relocated, as needed. Another noteworthy feature is that the operation of the treatment station 20 is not dependent on the integrity of building plumbing or electrical systems which may be inoperative during calamities, such as power failures, earthquakes and fires.

The cart 22 is a usual type of cart 22 consisting of a frame 35, a base 36 and a pair of wheels 37. The reservoir 23 is supported on the base 36 and retained to the cart 22 with a bracket 32 which is attached to the frame 35, a chain 39, a padlock 40, or other suitable means. The cabinet 24 is attached to a rear portion of the frame 35 with threaded or other suitable fasteners 41. The reservoir 23 is comprised of a cylindrical tank 42, a removable hand pump 43 and a pressure gauge 44. The hand pump 43 is a usual type of hand pump 43, such as those commonly used with tanks for spraying liquids. The hand pump 43 is removed in the usual manner by depressing and rotating a handle 45 to unlock the pump 43 from the tank 42. When the pump 43 is removed, there is a large opening in the top of the tank 42 for adding the eye washing fluid 21 such as water and additives 46 such as anti-bacterial agents.

After the eye washing fluid 21 and an anti-bacterial agent 46 have been added, the pump 43 is inserted into the tank 42 and rotated in a reverse direction to lock the pump 43 in the tank 42. The tank 42 is pressurized by rotating the handle a small amount to unlock the handle 45 and moving the handle 45 toward and away from the tank 42 a sufficient number of times until sufficient pressure is indicated on the pressure gauge 44. When this has been achieved, the handle 45 is depressed and rotated a small amount to lock the handle 45 to the tank 42. In the alternative, a valve 47 is provided in the tank 42 for introducing air under pressure from an external source, such as a compressor (not shown).

A wire hook 48 extends outwardly from one side of the cart 22 to support the applicator 26 and the flexible tube 30 which connects the applicator 26 to the tank 42. The flexible tube 30 which connects the applicator 26 to the tank 42, which is an important feature of the invention, serves several purposes. First, it allows the applicator 26 to be moved without a movement of the cart 22. Second, it allows the eye washing fluid 21 to be administered to a person in standing, sitting or prone positions. Third, it allows the applicator 26 to be manipulated relative to a patient's eye as opposed to applicators of current eye washing stations which are fixed.

The fluid disposal basin 27 is a generally rectangular basin 27, removably attached to a side of the cabinet 24, opposite the hook 48 which supports the applicator 26 and tube 30. The pail 28 which receives spent fluid 21 from the basin 27 is a usual type two gallon pail 28. As shown in phantom in FIG. 2, the short flexible tube 29 extends from a nipple at the bottom of the basin 27 into the pail 28. When the treatment station 29 is not in use the basin 27 and short flexible tube 29 are stored in the pail 28 at the bottom of the cart 22.

The applicator 26 which is shown in FIG. 1 is one of several types of applicators which are intended for use in the station 20. One type of applicator (not shown) is disclosed in a co-pending application Ser. No. 10/321,684, filed on Dec. 18, 2002 for an eye wash station, which is incorporated herein by reference. One feature of this applicator is that an eyelid is retracted and held in an open position by the applicator.

Figure 6:
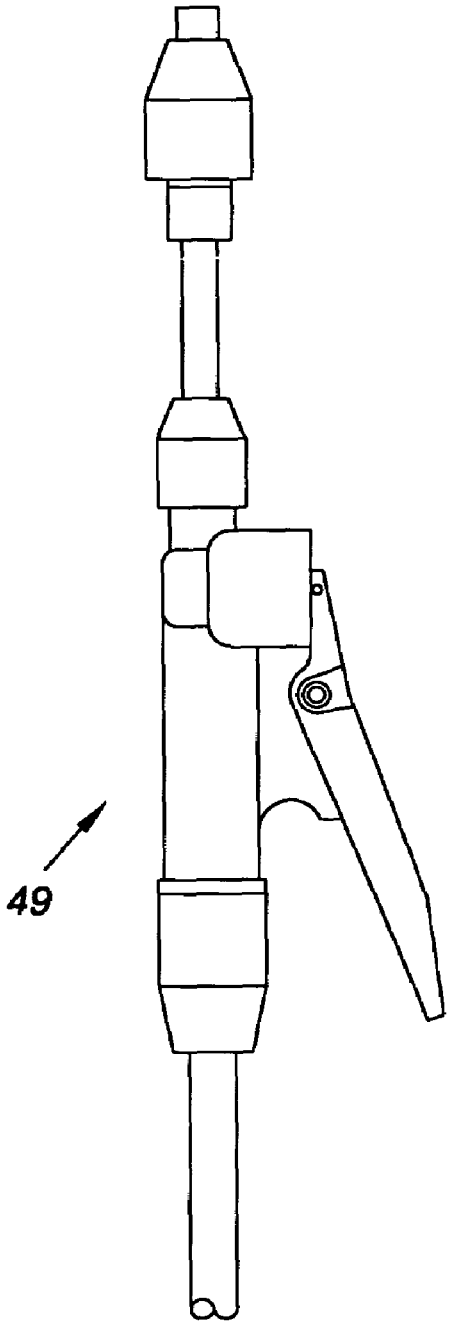
FIG. 6 is an enlarged left side view of a spray nozzle.
Figure 7:
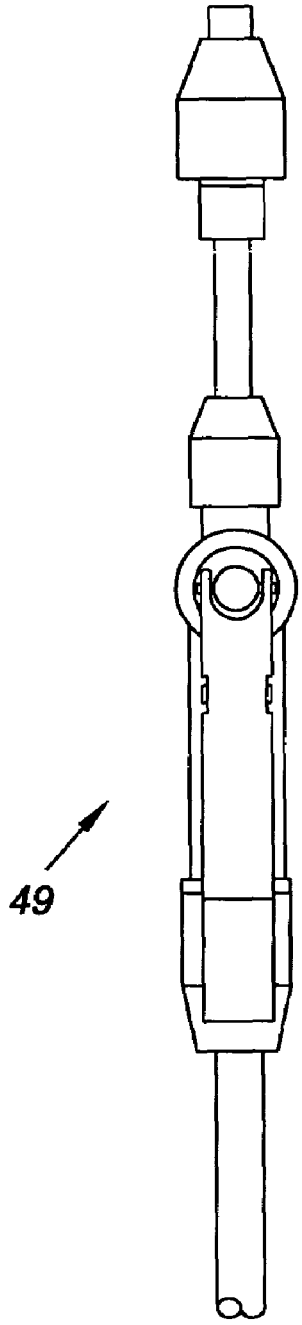
FIG. 7 is a plan view of the spray nozzle.

Another type of applicator 49 is the usual type of spray gun 49 shown in FIGS. 6 and 7. One benefit of this type of applicator 49 is that it can be used for spraying the eye washing fluid 21 on to body parts other than eyes which have been exposed to corrosive liquids, noxious gases and fires.

Figure 8:
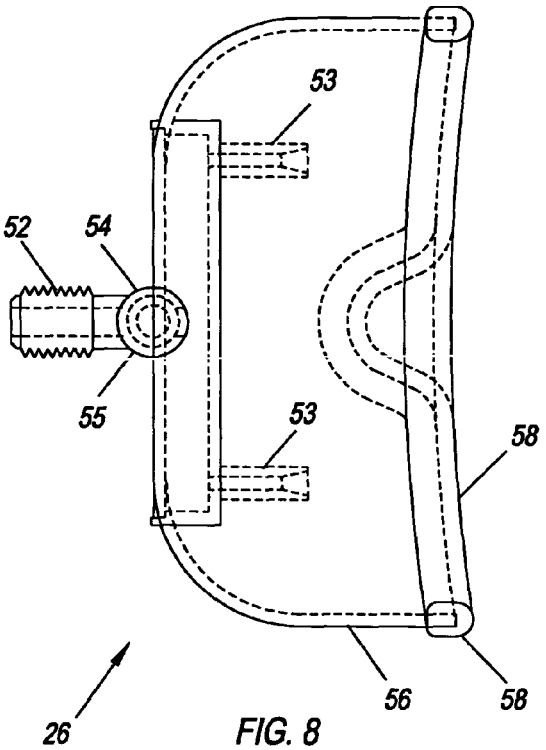
FIG. 8 is an enlarged plan view of a face mask.
Figure 9:
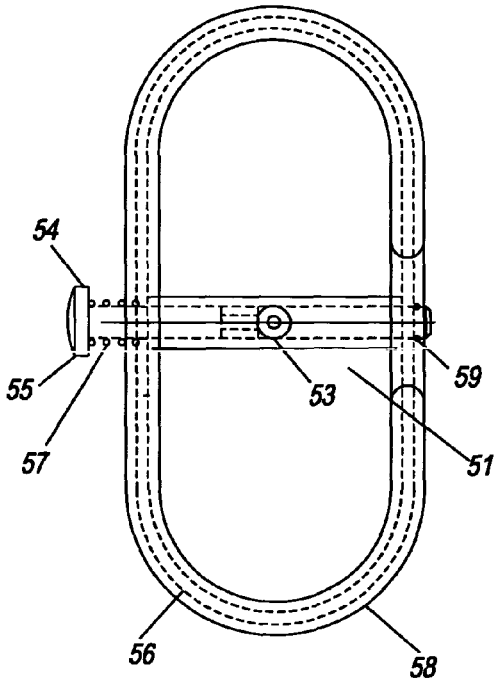
FIG. 9 is a front view of the face mask.
Figure 10:
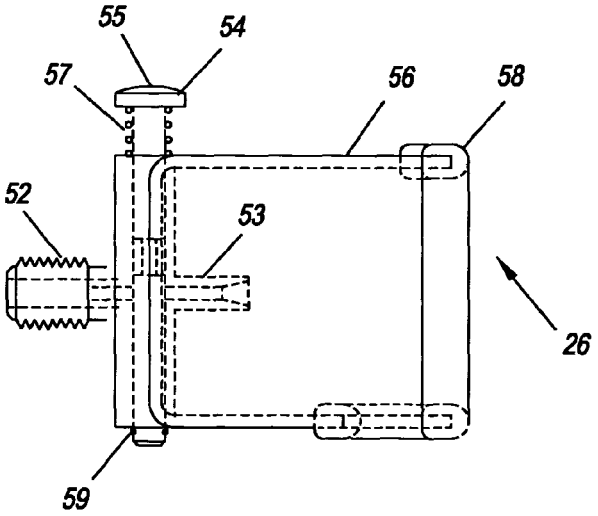
FIG. 10 is a right side view of the face mask.

A preferred construction for the applicator 26 is shown in FIGS. 8 through 10, inclusive. One benefit of the applicator 26 is that the eye washing is confined to a pair of eyes and surrounding tissue, thereby conserving the eye washing fluid 21 in the reservoir 23. The applicator 50 includes a housing 56 having an open rear portion 51 for enclosing the pair of eyes, a rearward extending nipple portion 52 for attaching the flexible tube 30, a pair of spaced apart rearward extending nozzle portions 53, a normally closed valve 54 for controlling the spray of the eye washing fluid 21 from the nozzle portions 53, and a seal 58. The valve 54 is comprised of a valve body 55, slidably mounted in the body 55, a coil spring 57 for biasing the valve 54 in a closed position and a ring 59 for retaining the valve body 55 in the housing 56.

Figure 11:
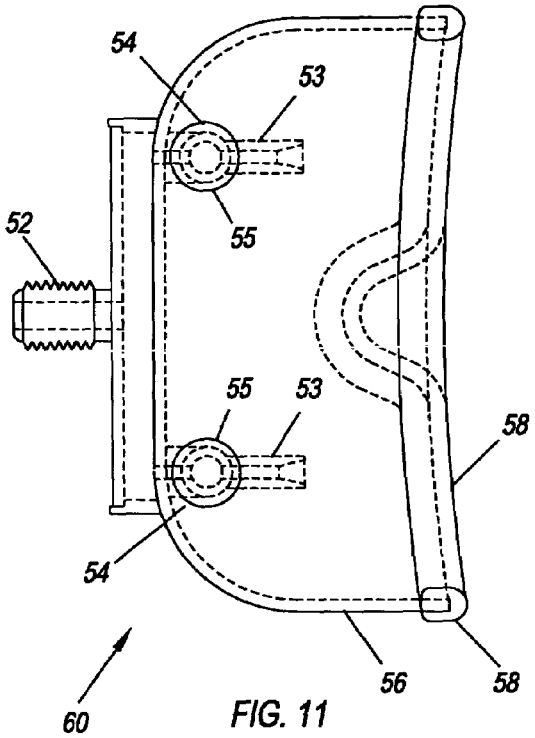
FIG. 11 is an enlarged plan view of a second embodiment of a face mask.
Figure 12:
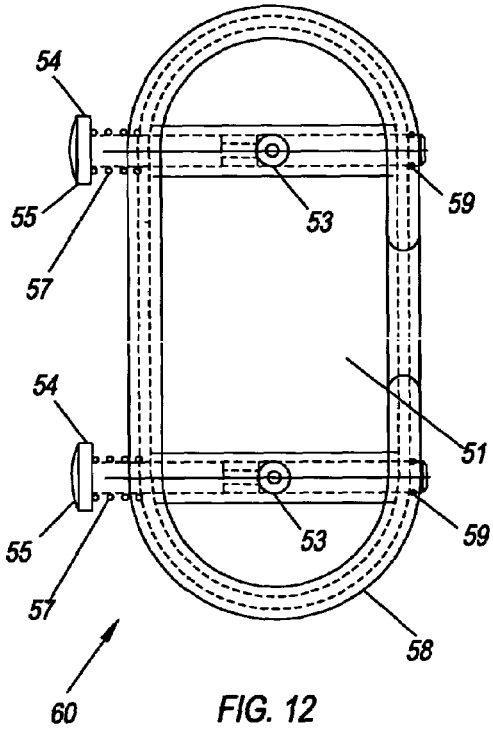
FIG. 12 is a front view of a second embodiment of the face mask.
Figure 13:
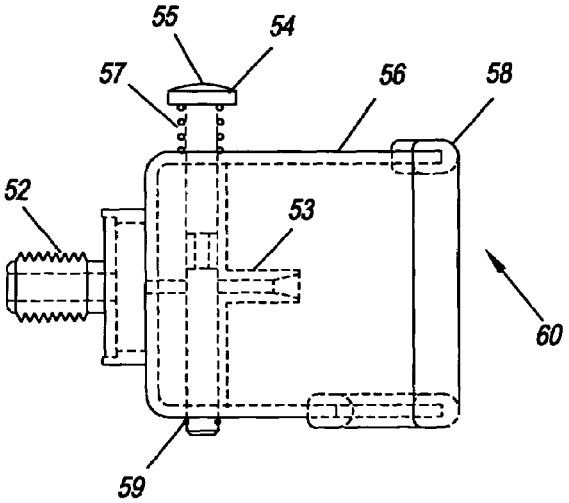
FIG. 13 is a right side view of a second embodiment of the face mask.

In FIGS. 11 through 13, inclusive, an alternate applicator 60 is shown having a pair of normally closed spring biased valves 54 for individually controlling the sprays of eye washing fluid 21 from each of the nozzle portions 53.

The eye treatment station 20 is intended to be situated in a hazardous work area or at the site of an injured person, by way of example, a work place or hospital emergency room. The "stand alone" station 20 can also be carried in an ambulance or vehicle to an accident or disaster site.

From the above, it will be appreciated that our eye treatment station provides features and benefits heretofore unavailable for treating eye injuries. Moreover, it is a "stand alone", compact and portable station which can be available on an "as needed" basis or placed at such diverse locations as construction sites, sporting events or battlefields. Still further, treatment can be administered to an injured person in a standing, sitting or prone position. Still further, medications and eye protective materials, such as antibiotic ointments, sterile gauzes and adhesive tapes are immediately available for limiting injury and preventing infection.

Although only several embodiments have been illustrated and described for purposes of disclosing our invention, it is not our intention to limit our invention to these embodiments since obvious embodiments can be derived by changes in material, shape, elimination, substitution and changes in arrangement of parts without departing from the spirit thereof.

We claim:

1. An eye injury treatment station comprising: a reservoir for storing an eye washing fluid, said reservoir having a manual means for pressurizing said eye washing fluid in the interior of said reservoir, an eye washing fluid in the interior of said reservoir; at least one hand held applicator at a remote location from said reservoir, said applicator connected to said reservoir with a flexible elongated tube for retracting an eyelid and spraying said eye washing fluid into an injured eye of a person who is standing or laying in a horizontal position; an elongated flexible tube of sufficient length for connecting said remote applicator to said reservoir and positioning said applicator adjacent to said injured eye; and a cart for transporting said reservoir, said applicator and said flexible tube; said cart having a frame and a pair of wheels.

2. The eye injury treatment station recited in claim 1 wherein said reservoir comprises a tank and a pressure gauge mounted in said tank.

3. The eye injury treatment station recited in claim 1 further comprising a cabinet attached to said cart for storing eye treatment substances.

4. The eye treatment station recited in claim 1 further comprising a means for retaining said reservoir to said cart comprising a bracket on a frame, a chain and a padlock.

5. The eye treatment station recited in claim 1 further comprising an antibacterial agent stored in said reservoir.

6. The eye treatment station recited in claim 1 wherein said applicator is a face mask for enclosing at least one eye, said face mask having a housing portion for enclosing said eye and a spray nozzle portion in the interior of said housing portion for spraying said eye washing fluid into said eye and a valve for controlling a discharge of said spray from said spray nozzle portion.

7. The eye treatment station recited in claim 6 further comprising a spray gun.

8. The eye treatment station recited in claim 6 wherein said face mask further comprises a second nozzle portion for spraying said eye washing fluid into a second eye.

9. The eye treatment station recited in claim 8 wherein said face mask further comprises a second valve in said applicator housing for controlling a discharge of said spray from said second nozzle portion.

10. The eye treatment station recited in claim 1 wherein said applicator is a spray gun.

11. The eye treatment station recited in claim 1 further comprising a means for collecting and disposing spent eye washing fluid.

12. The eye treatment station recited in claim 1 further comprising a second applicator for spraying said eye washing fluid into said eye.

13. An eye injury treatment station comprising: a reservoir for storing an eye washing fluid, said reservoir having a gauge for displaying a pressure in said tank, a hand operated pump mounted in said reservoir for developing said pressure in the interior of said reservoir; an eye washing fluid stored in said reservoir, said eye washing fluid including an anti-bacterial agent for preventing contamination of said eye washing fluid; at least one hand held means at a remote location from said reservoir, said hand held means connected to said reservoir for retracting and holding open an eyelid and spraying said eye washing fluid into an eye of an injured person who is lying or is standing;

an elongated flexible tube for connecting said spraying means to said reservoir; a means for collecting said eye washing fluid after said spraying; and a cart for transporting said tank, said eye washing fluid, said applicator, and said pump.

14. The eye injury treatment station recited in claim 13 further comprising a cabinet attached to said cart for storing eye medications and eye covering materials.

15. The eye injury treatment station recited in claim 13 wherein said fluid spraying means comprises a mask for enclosing said eye, said mask having a spray nozzle portion for spraying said eye washing fluid into said eye.

16. The eye injury treatment station recited in claim 13 wherein said eye washing fluid spraying means comprises a mask for enclosing said eye, said mask having a nozzle portion in the interior of said mask for spraying said eye washing fluid into said eye; and a spray gun for optionally spraying said eye washing fluid into said eye.

17. The eye injury treatment station recited in claim 13 wherein said eye washing fluid collecting means comprises a detachable basin attached to said cart for collecting said fluid; a removable pail for receiving fluid from said basin; and a flexible tube attached to an outlet portion of said basin for directing said fluid into said pail.

* * * * *